US010213642B2

(12) United States Patent
Swarts

(10) Patent No.: US 10,213,642 B2
(45) Date of Patent: Feb. 26, 2019

(54) TERRAIN BELT FOR USE WITH A TREADMILL

(71) Applicant: Katie Swarts, Pflugerville, TX (US)

(72) Inventor: Katie Swarts, Pflugerville, TX (US)

( * ) Notice: Subject to any disclaimer, the term of this patent is extended or adjusted under 35 U.S.C. 154(b) by 0 days.

(21) Appl. No.: 15/581,584

(22) Filed: Apr. 28, 2017

(65) Prior Publication Data

US 2018/0311528 A1 Nov. 1, 2018

(51) Int. Cl.
*A63B 22/02* (2006.01)

(52) U.S. Cl.
CPC ..... *A63B 22/0285* (2013.01)

(58) Field of Classification Search
CPC . A63B 22/02; A63B 22/0207; A63B 22/0228; A63B 22/0285; A63B 69/0028; A63B 69/0035; A63B 2069/0037; A63B 71/0054; A63B 2071/0063; A63B 2209/00; A63B 2209/02; A63B 2209/023; A63B 2209/026; A63B 2209/10; A63B 2209/14
See application file for complete search history.

(56) References Cited

U.S. PATENT DOCUMENTS 4,329,981 A * 5/1982 Dungl ..... A61H 7/001 601/28
4,552,713 A * 11/1985 Cavicchioli ..... A63B 53/14 264/162
5,158,073 A * 10/1992 Bukowski ..... A61H 39/04 5/944
5,186,703 A * 2/1993 Huang ..... A61H 7/001 482/148
5,205,800 A * 4/1993 Grant ..... A63B 22/02 198/861.5
5,527,241 A * 6/1996 Peng ..... A61H 7/001 482/51
6,663,540 B1 * 12/2003 Huang ..... A63B 22/02 482/54
6,918,859 B1 * 7/2005 Yeh ..... A61H 7/001 482/54
7,510,511 B2 * 3/2009 von Detten ..... A63B 22/02 482/54
7,625,625 B2 * 12/2009 Rios ..... A43B 13/22 428/141
7,833,135 B2 * 11/2010 Radow ..... A63B 22/0605 482/4
7,976,437 B1 * 7/2011 von Detten ..... A63B 22/0235 482/54
8,251,874 B2 * 8/2012 Ashby ..... A63B 22/02 482/4
9,012,341 B2 * 4/2015 Rohr ..... A63B 22/02 442/221
9,039,579 B1 * 5/2015 Osime ..... A63B 22/14 482/51

(Continued)

FOREIGN PATENT DOCUMENTS

EP 2540354 A2 * 1/2013 ..... A63B 22/0235

*Primary Examiner* — Gary D Urbiel Goldner
(74) *Attorney, Agent, or Firm* — J. Roger Williams, Jr.; Richards, Rodriguez & Skeith, LLP

(57) ABSTRACT

For use with a treadmill, a treadmill belt including terrain-simulating protrusions containing hard beads to simulate rocky terrain when walked or run upon by a user. In an embodiment, the hard bead is a glass bead. An embodiment includes layers of a silicone compound on the treadmill belt and covering the hard beads.

7 Claims, 1 Drawing Sheet

(56) References Cited

U.S. PATENT DOCUMENTS

| | | | | |
|---|---|---|---|---|
| 10,010,748 | B1 * | 7/2018 | Weinstein | A63B 22/0285 |
| 2004/0132586 | A1 * | 7/2004 | Leighton | A63B 22/02<br>482/54 |
| 2004/0192511 | A1 * | 9/2004 | Ein-Gal | A61H 7/001<br>482/54 |
| 2005/0170935 | A1 * | 8/2005 | Manser | A63B 22/02<br>482/54 |
| 2007/0060451 | A1 * | 3/2007 | Lucas | A61H 7/001<br>482/54 |
| 2007/0072743 | A1 * | 3/2007 | Severino | A63B 22/0242<br>482/54 |
| 2007/0275827 | A1 * | 11/2007 | Glaser | A63B 21/4037<br>482/23 |
| 2007/0298937 | A1 * | 12/2007 | Shah | A63B 22/02<br>482/54 |
| 2008/0009396 | A1 * | 1/2008 | von Detten | A63B 22/02<br>482/54 |
| 2008/0176719 | A1 * | 7/2008 | To | A63B 22/0235<br>482/54 |
| 2013/0184376 | A1 * | 7/2013 | Baidak | C08G 81/00<br>523/400 |
| 2013/0274067 | A1 * | 10/2013 | Watterson | A63B 24/0087<br>482/5 |
| 2013/0281241 | A1 * | 10/2013 | Watterson | A63B 22/0285<br>474/268 |
| 2014/0295140 | A1 * | 10/2014 | King | A43B 13/02<br>428/156 |

* cited by examiner

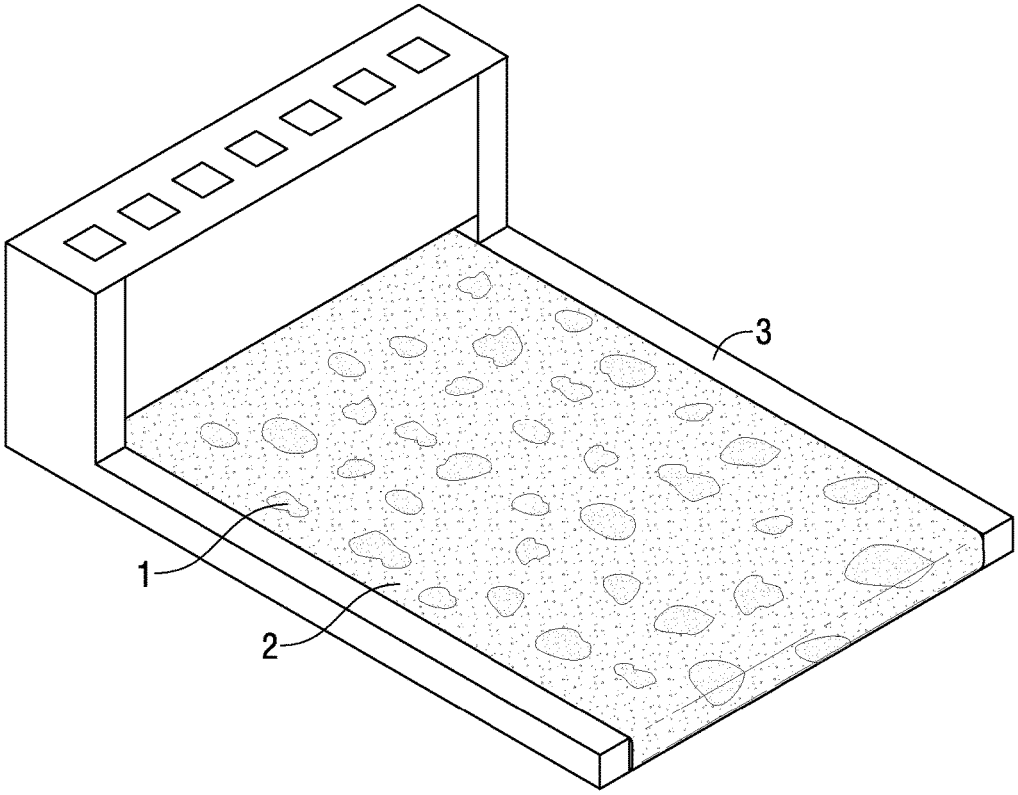
3
1
2

TERRAIN BELT FOR USE WITH A TREADMILL

BACKGROUND

Each year, 50% of Americans over the age of 18 develop a musculoskeletal injury that lasts longer than 3 months and requires PT. Patients are expected to conform to the therapy's preset mold. By having to do so, individual patient care needs are overlooked. This structure relies heavily on strength/endurance training and these exercises can be performed only so many ways which causes every patient to be treated the same regardless of their situation.

Patients across this industry are being adversely affected by the system that is currently in place, being a repetitive exercise regimen, and leaving the patient dependent on a circuit of exercises to lead them to recovery. Currently, the patients' recovery is completely reliant on the patient, which is not easy for the working class, students, the elderly, and many others who are fatigued by the time they would have to practice the previously mentioned exercise routine.

U.S. Pat. No. 8,251,874: An exercise device that is able to simulate terrain found in the real world, the device programming can include pictures and videos of the chosen location. The programming can allow the user to experience the topographical changes due to the changing operating parameters. The patent details the physical conditioning of the consumer that purchases this exercise system, this is very impractical this is very impractical for the average consumer; for consumers that already have an exercise system the purchase of the an entirely new system with the heavy programming and mechanical complexities would be outrageously expensive to replace a working system that could alternatively acquire an add-on device to achieve the same effect for the consumers "physical conditioning." Although this exercise system is highly customizable, the programming for such control over multiple operating parameters would be very costly to mass produce and even more so costly for the consumer because of the margin of profit the inventor and the manufacturer would require. The design of this system is highly impractical overall unless the outlook for manufacturing costs are low and the consumer price follows a steady trend. Exercise systems for simulating real world terrain "provides a user with the opportunity to engage in simulating real world terrain comprised of instructive or ideal images and/or adoptable, controllable images" this feature is not a necessity of functionality and is more so geared towards a virtual reality simulation; this is good for specialized training simulations but for the average user or those in physical therapy this is excessive. This type of simulation can also cause symptoms similar to motion sickness.

U.S. Pat. No. 5,205,800: The all terrain treadmill is a treadmill with a monitor and a video player; speed and slope will be synchronized with the chosen terrain, "the machine can be programmed and fed into a control system and a video can be displayed on the video screen synchronized with the control of the grade of the platform." The all terrain treadmill is similar to the previously mentioned patent, it requires heavy program synchronization with the mechanical inter-workings of the treadmill. Like the previously mentioned patent it is not cost effective for the consumer by using unnecessary virtual reality components.

US20070298937: Surface modified exercise belt for a treadmill is an exercise belt that simulates the natural ground; to strengthen the muscles of the user's ankles. The modified surface is either protrusions or attached pads of varied shape, thickness, hardness, and spacing. A kit is provided containing pads of varying shapes, thickness, and hardness attachable via an adhesive. The kit allows users to randomize and customize the lateral shape of the uniformly placed protrusions. The users being able to create different lateral shapes can cause the belt to have design errors such as: the clearance area of the belt can be altered which is a tedious task for the user to keep in mind; if the user makes a mistake they could potentially ruin the belt because of adhesive could be ripped off and this is inconvenient for the user. The belt should be a module in the user's training process and is not supposed to be infinitely changing, there is going to be a plateau just like every other form of exercise. Although this design focuses on strengthening the user's ankles it can be done in a less complicated way.

US20130274067: The System and method for simulating environmental conditions on an exercise device is an exercise system includes a simulation system simulating terrain based on environmental and real world conditions using topographical data, a location can be simulated. The exercise system may include speed, incline, and other mechanisms. This is a very specific training system that would be very expensive to implement into the life of an everyday consumer and would be very costly, especially because the profit margin for the inventor and the manufacture is high due to the programming and the hardware required to mass produce an exercise system of this capacity that uses such a wide pool of data which includes almost every location in the world. This is very impractical for the everyday consumer and even institutions such as hospitals, and physical therapy facilities.

U.S. Pat. No. 7,833,135: The stationary exercise equipment is a control system and method for exercise equipment provides a way to simulate exercise. The machine allows the user to experience physical activity to be simulated rather than using exercise equipment. This type of simulation can be very helpful however the user has to implement such equipment and with the other innovations available with updated technology makes it harder to justify. There is also the "real world" simulation that this is missing, it is a gentle exerciser that can preserve the joints of the user but it may not be able to strengthen the correct joins because the simulation of exercise is very limited.

The prior inventions and innovations are all so similar with using rubber as the protrusions to simulate a rockier terrain. Terrain is something that is similar in many ways and there will always be overlap between designs however glass beads are more similar to the way that rocks feel underneath the user's feet, rubber has some flexibility and rocks do not. The glass beads are sturdy enough to be able to be roughly handled as they will not break and can handle a considerable amount to pressure and stress. The texture modifiable terrain belt is uses a silicone base which encases the glass beads securely and has more real terrain simulation than a foam or padding.

Prior inventions are hard to implement into physical therapy practices or hospitals or even the average household because many of them are exercise systems or machines that are costly to produce and even more so costly to buy due to the company profits. The Mod belt can be added to a wide array of pre-existing exercise machines or can even be utilized without a machine. The design is space conscious and is not too bulky, prior inventions are not very versatile in the sense that they cannot be easily implemented into any circumstance such as physical therapy practices, hospitals, or even the average household. Many of these prior inventions are exercise systems or stand-alone machines that take up space, is costly to produce and purchase, and cannot be added to a pre-existing apparatus.

DETAILED DESCRIPTION

Modules: In physical therapy the progression of strengthening exercises is working the different muscle groups however the exercises may not be able to extend beyond a certain point. By creating modules for patients they can work in terms of levels to build the stability that they need and then be given exercises to do at home to further challenge the targeted muscle groups. Drilling the same exercises day in and day out can end up not working for the long term but learning how to correctly do something in real life situations would last a lifetime. For instance, I have been in intensive physical therapy long term and have been told to, for example, tighten my abs when I pick up my backpack however I have no way to know if I am doing so correctly. Simulating real life situations would greatly benefit the patient.

Simulate Real Life: Many physical therapy practices only offer their patients different exercises to help the problem. For example, what if we created a mat with different textures to simulate pavement, gravel, mud, grass etc. for people learning how to walk again. I am hypermobile and often dislocate my shoulder by simply picking up my backpack; what if we created a system where you pick up heavy items a certain way, such as a backpack, to strengthen the muscle and instruct the patient on ways to correctly pickup said item.

Workout Systems: You can often end up doing the same exercises over and over again and after a while you develop boredom and start doing them incorrectly. By creating a new workout machine that could work the same muscle groups in different ways would benefit the patient and challenge the same muscle group ultimately making them stronger. Eventually the patient will learn the pattern of the different belts however the Mod belt is one of the last steps of the patient's care.

Home Programs: Committing to exercising every day takes away from your time but is beneficial to your health.

Customizable Program: The exercises/treatments are universal meaning that they are not made to fit the patient.

Legal: One issue that arises in this practice is the inevitable lawsuit against the physical therapist. These issues cannot be avoided however if the right precautions are taken the suits against the therapist can be limited. With creating a product in this field, patients can be putting their health at risk. It can be inferred that patients can be set back after using the product due to pushing themselves too far before they are ready for this advanced module. The product should be used when the patient has reached a plateau, or a static period, where they are not progressing anymore. This advancement could be implemented in the final level of the patient's rehabilitation. A product requires a patent to ensure that it is successful; for a provisional patent it is 2,000 for an attorney's time and then $130 for a filing fee and $125 per page. When creating a product there are warnings set out to the consumers to prevent any misuse of the product. It could also be proven dangerous for the patient and could cause setbacks. This type of product should be one of the most advanced stages in the patient's rehabilitation program. The physical therapists have the ultimate decision when using this product with their patients but the product instructions should be strictly followed to ensure its correct use. When the product hits the market an important factor is product viability. This is important because if the product presents a set of problems the patient could be at risk, thus the importance for a good product is vital for the success of the patient.

Economical: The U.S. Physical Therapist industry is expected to grow despite the healthcare reform and economic recovery. More of the population has become mindful of the benefits that physical therapy provides. Due to this new awareness the industry is rapidly expanding and evolving. Costs of the physical therapy equipment are an economical concern; while creating a product in this field the cost of said product must be kept in mind in order for it to be successful among a wide array of practices. If practices can save money by buying what they deem necessary to their practice another product that is versatile to many specialties could be successful in the field. The cost of physical therapy to patients is another issue to be addressed. Patients covered by health insurance, out-of-pocket costs typically consist of a copay of $10-$75 per session; patients that do not have insurance the physical therapy typically costs $50-$350 or more per session. On the U.S. market there are products marked as small, medium, or large and in the physical therapy field there is 'one size fits all' whether it describes a bike seat, a resistance band, or virtually anything else. This can be uncomfortable for the patients that fall out of the 'one size fits all' product, especially when going through their 'personalized' rehabilitation program. Some of the people that cannot cope with the one size fits all mentality are people with chronic illnesses. These patients require more customization than the physical therapist can offer with their prescribed exercise regimen without compromising the integrity of the effectiveness of the exercises. An economic issue that physical therapists face is "assuming personal responsibility for continuing education to keep up with new treatment ideas in order to maintain quality of care. The therapists have to constantly skim the market to see if any new and improved methods could help their patients so they can advance their care. Without new products or methods out on the market the practices could become static and not progressive.

Health & Safety: With products in this field there is a reasonable amount of importance for a good quality product because of the risk presented. A process should be followed to assess the safety of products thoroughly enough to declare its degree of safety. One group of people who could benefit from this product are patients who have suffered from strokes. While these patients are often elderly and could be fragile they could potentially use this to regain lost skills. Depending on the severity of each case the progression of the difficulty would vary when using this product. Another group of people who could benefit are injured soldiers returning from war. This type of product could be applied to rehabilitation with prosthetics or rehabilitation of relearning how to walk due to various causes. The physical therapy practice provides a safe and controlled environment to patients and introducing a new tool to patients could introduce some level of risk. Patients who are in the process of healing can be prone to having a fall risk. With reestablishing the skills necessary for balance there is definitely a risk of them losing their balance and possibly falling which puts the patient at risk; due to equipment being used to help regain the coordination the risk of injury is much greater.

Technical Problems: A product in this field must be sanitary, ergo one of the questions we must ask while considering materials is, how easy can this material be cleaned? One of the materials that is commonly used in physical therapy practices is foam. Foam, all the while helpful by adding a challenge to the patient's care is hard to clean. The largest concern is infectious diseases. Another problem that our product may face is supply. Supply simply refers to how many mats a practice can house. Not all practices are spacious therefore while designing and creating this product space has to be considered. The urban sprawl is quickly descending on the land which creates a race for space. The design of this product should be compact and consider the limited space that smaller practices have; so that physical therapists can have more of the mats we provide and can easily incorporate them into their respective practices. As this product is created we must think in a long term mindset, maintenance of the product has to be kept in mind. We created the Mod belt which has different terrain belts, which indeterminately means that we have to take its daily use into consideration and choose high quality materials accordingly. In the field of physical therapy it is difficult to measure the level of success due to the fact that the patient's success is completely dependent on the patient. The Mod belt will completely eliminate the patient's success being reliant solely on how much effort they put into their program. The Mod belt simulates the earth and exposes the patient to something that they will face in real life, which is a skill set they need to recover; therefore the patient's success is based on how well they can walk on the different terrains. Although the Mod belt does allow success to be measured by how well the patient can walk on the different terrains the physical therapist and the patient are ultimately in control of how well the patient does and when the patient should be discharged.

Education: Treating a traumatic brain injury can require rehabilitation and soldiers are physically fit and generally healthy which makes them the best candidate for a treatment such as the Mod belt. The elderly recovering their balance are also decent candidates for the Mod belt. However, the patient's health could be at more of a risk. This is a concern for the elderly who may use the Mod belt; they could potentially trip or lose their balance while walking due to the different textures. The physical therapist should use caution with their patients and consult the patient for readiness before using this product since the patients are already prone to having a fall risk. The Mod belt is not only for those who need rehabilitation but those who need to train. Triathletes can use its many terrains in combination with the concepts that we had for this project. For tough terrain training when a certain trail is unavailable, the training can be brought inside and can be used as a substitute for being out in the environment. Another group that can greatly benefit from all that the Mod belt has to offer is children that suffer from birth defects. Children are active and being exposed to the different terrains early on will greatly benefit them in having a good foundation of this particular skill set for the rest of their lives.

The belt itself has glass beads ranging from a small size of 30 millimeters to a larger size of 150 millimeters, attached with an adhesive. Then the first layer of silicone is applied to cover the belt and close gaps between the glass beads and the belt. The second layer of silicone covers the belt and the tops of the beads, which encases the glass beads. The last layer of silicone is to create fluidity of texture and to blend the previous layers of silicone. There is then vertical strips of VELCRO® brand hook and loop fasteners attached to the underside of the belt that folds over and attaches to itself.

Glass beads are not malleable, whereas rubber is and if under enough stress could prove to give way. Glass does not wear like rubber would; over long term use the rubber will begin to change shape or tear. Glass does not really wear down as easily. Glass is hard like stone and would give the user a more realistic experience.

BRIEF DESCRIPTIONS OF THE DRAWINGS

FIG. 1 shows the mod belt in its entirety; 1 represents the glass beads on the belt; 2 represents the silicone which encases the previously mentioned beads; 3 represents a treadmill frame on which the belt is fitted.

What is claimed is:

1. A terrain belt for use with a treadmill, the terrain belt comprising:

a treadmill belt;

a plurality of terrain-simulating protrusions adhered to the treadmill belt and arranged and configured in a seemingly random order to create a sensation of a rocky terrain when walked or run upon by a user, wherein each of the plurality of terrain-simulating protrusions comprises a glass bead covered by a silicone compound; and one or more layers of the silicone compound covering the treadmill belt and the plurality of terrain-simulating protrusions.

2. The terrain belt of claim 1, wherein a size of the glass beads ranges from 30 millimeters to 150 millimeters.

3. The terrain belt of claim 1, wherein each of the plurality of terrain-simulating protrusions is adhered to the treadmill belt with a thermoplastic adhesive.

4. The terrain belt of claim 1, wherein the treadmill belt comprises a first end and a second end fastened together with a hook-and-loop fastener.

5. The terrain belt of claim 1, wherein the treadmill belt comprises cloth.

6. The terrain belt of claim 1, wherein the treadmill belt is a two-ply belt comprising polyurethane, nylon, and polyester.

7. The terrain belt of claim 1, wherein the silicone compound comprises silicone caulk.

* * * * *